US006732793B1

(12) United States Patent
Lee

(10) Patent No.: US 6,732,793 B1
(45) Date of Patent: May 11, 2004

(54) DOWNHOLE JETTING TOOL

(75) Inventor: Paul Bernard Lee, Dubai (AE)

(73) Assignee: Drilling Systems International Ltd., Georgetown (KY)

( * ) Notice: Subject to any disclaimer, the term of this patent is extended or adjusted under 35 U.S.C. 154(b) by 0 days.

(21) Appl. No.: 09/980,669

(22) PCT Filed: Jul. 7, 2000

(86) PCT No.: PCT/GB00/02523

§ 371 (c)(1),
(2), (4) Date: Mar. 26, 2002

(87) PCT Pub. No.: WO01/04457

PCT Pub. Date: Jan. 18, 2001

(30) Foreign Application Priority Data

Jul. 8, 1999 (GB) ..... 9915885

(51) Int. Cl.[7] ..... E21B 21/00

(52) U.S. Cl. ..... 166/222; 166/311; 166/318; 175/313

(58) Field of Search ..... 166/311, 222, 166/312, 318, 329, 223; 175/313

(56) References Cited

U.S. PATENT DOCUMENTS

| | | | | |
|---|---|---|---|---|
| 2,312,018 A | | 2/1943 | Beckman | |
| 2,327,051 A | | 8/1943 | Lyons et al. | |
| 3,066,735 A | * | 12/1962 | Zingg | 175/234 |
| 4,031,957 A | * | 6/1977 | Sanford | 166/264 |
| 4,889,199 A | | 12/1989 | Lee | |
| 5,499,687 A | | 3/1996 | Lee | |
| 5,533,571 A | * | 7/1996 | Surjaatmadja et al. | 166/222 |
| 6,065,541 A | * | 5/2000 | Allen | 166/318 |

* cited by examiner

*Primary Examiner*—David Bagnell
*Assistant Examiner*—Jennifer Dougherty
(74) *Attorney, Agent, or Firm*—Merchant & Gould P.C.

(57) ABSTRACT

There is provided a jetting tool assembly for use in cleaning tubular components used in drilling for gaseous or liquid hydrocarbons in producing formations, said assembly being connectable to a hollow drillstring and having a first mode of operation which allows through-flow of fluid and lengthwise of the drillstring, and a second mode of operation which routes the fluid transversely outwardly of the drillstring.

7 Claims, 3 Drawing Sheets

DOWNHOLE JETTING TOOL

Figure 1:
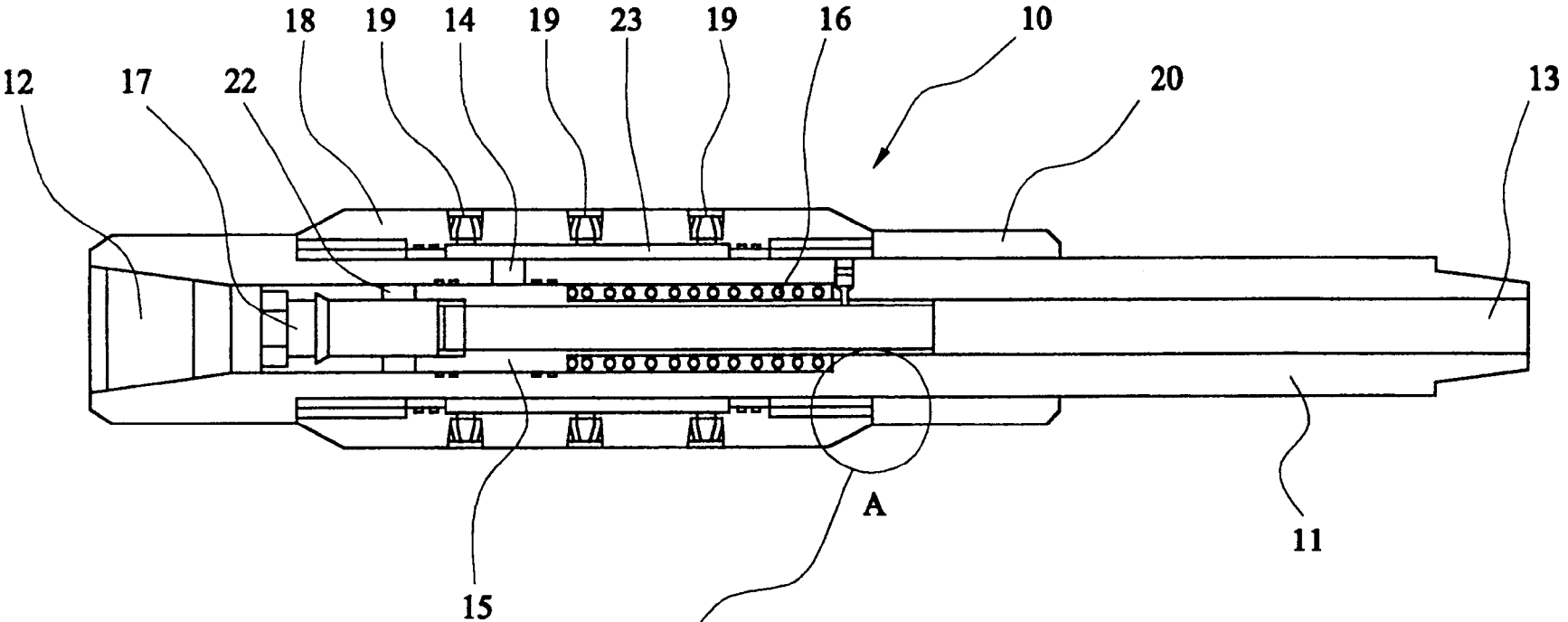

This invention relates to a jetting tool assembly for use with a drill string, and particularly, though not exclusively, for cleaning tubular components used in drilling for gaseous or liquid hydrocarbons.

It is known to assemble a downhole valve in a drillstring, and to convey the valve to a required location in a producing formation, and then to supply drilling fluid (mud) to the working end of the drillstring via the downhole valve.

In particular, it is known from U.S. Pat. Nos. 4,889,199 and 5,499,687 to provide a downhole valve in a drillstring, and which comprises a tubular casing for mounting in the drilistring, and which allows through-flow of fluid during normal drilling operations.

There is first outlet means in the casing for discharging fluid laterally outwardly from the casing, and a sleeve slidably mounted in the casing and biased by a spring to a closed position in the casing in which the sleeve closes the first outlet means. There is also second outlet means in the sleeve for discharging fluid from the sleeve when the first and second outlet means are aligned. There is also provided a first ball (which is a large deformable ball of plastics material), which can be dropped down the drillstring i.e. launched, and which can be driven by pressure of the drilling fluid to a position of engagement with the downhole valve in order to adjust its operation. In particular, the large ball can engage the sleeve and cause it to move relative to the casing into an open position in which the first and second outlets are aligned in order to discharge fluid laterally through the casing e.g. in order to inject lost circulation material into the surrounding formation when fluid is being lost to the formation.

Furthermore, a second smaller hard ball (a deactivating ball) can then be dropped down the drillstring, and which first blocks the second outlet so that pressure on the first and second balls then increases sufficiently to drive the first (deformable) ball through the sleeve, when it is required to restore normal flow of drilling fluid through the sleeve and for allowing the return of the sleeve to the closed position (blocking communication between the first and second outlet means).

The present invention is primarily concerned with an improved version of downhole valve of the type generally disclosed in these two US patents, to provide a jetting tool assembly which is especially (though not exclusively) suitable for cleaning tubular components used in drilling for gaseous or liquid hydrocarbons.

According to the invention there is provided a jetting tool assembly for use in cleaning tubular components used in drilling for gaseous or liquid hydrocarbons in producing formations, said assembly being connectable to a hollow drillstring and having a first mode of operation which allows through-flow of fluid and lengthwise of the drillstring, and a second mode of operation which routes the fluid transversely outwardly of the drilistring, in which the assembly comprises:

- a hollow main body through which axial flow of fluid can take place between an inlet end and an outlet end of the main body, in the first mode of operation;
- outlet port means in the wall of the main body through which fluid can flow transversely of the drillstring in the second mode of operation;
- a control sleeve slidably mounted in the main body for movement between a first position in which it blocks communication between the interior of the main body and said outlet port means, and a second position in which it allows communication between the interior of the main body and the outlet port means;
- means biassing the sleeve towards said first position;
- a ball receiver arrangement at one end of the sleeve to receive a ball when the latter is launched down the drillstring to activate the tool assembly, said arrangement being operative when engaged by a launched ball to move the sleeve to the second position against the biassing means;
- a jetting body mounted externally on the main body; and
- one or more jet outlets in the wall of the jetting body and communicating with said outlet port means so as to direct fluid outwardly against the internal wall of a surrounding tubular component for cleaning purposes when the tool assembly has been activated.

A tool assembly according to the invention may therefore be used to advantage during well "completions". The tubular components which may be cleaned may comprise a BOP (blow out preventer), a casing or a riser i.e. generally large diameter pipes.

Preferably, a series of cleaning jet outlets is provided in the wall of the jetting body, and arranged to direct jets of cleaning fluid radially outwardly, or outwardly at an angle as may be required.

The jetting body is mounted on the main body to form a rigid assembly, and preferably is assembled by slidable movement lengthwise of the main body to take up a required axial location on the main body, and then can be locked in position e.g. by a retainer nut.

The jetting body is therefore held captive against movement longitudinally of the main body upon assembly, but preferably it is also held against relative rotation.

Conveniently, there is a spline and groove type interfit between the main body and the jetting body, and which may be provided by a series of spline bars and respective grooves arranged at equal circumferential spaces along the interface between the outer surface of the main body and the inner face of the jetting body.

If, for example, eight splines and grooves are provided, then in the event of unacceptable excessive wear arising on any surface of the jetting body, the assembly may be released to allow slidable separation, followed by relative angular adjustment e.g. through 45°, to align the spline bars and the grooves, and slidable assembly again, but this time bringing a new surface of the jetting body to be engaged by the fluid flowing outwardly of the outlet port means in the main body.

If desired, plug inserts may be provided in the jet outlets in the wall of the jetting body to assist in unplugging any debris lodging in the jet nozzles.

A ball catcher device may be arranged below the tool assembly, to catch the balls used to activate the tool assembly, such balls being dislodged by being deformable under the action of a second, hard deactivating ball launched down the drill string, so that the sleeve returns to its first position, and the activating deformable ball (and the deactivating ball) can move lengthwise of the sleeve to be caught by the catcher device.

To prevent any balls in the catcher device from being return to the surface, a retainer flap may be provided which acts like a one way valve, to allow downward movement of the balls from the sleeve, but prevents return movement.

Figure 1A:
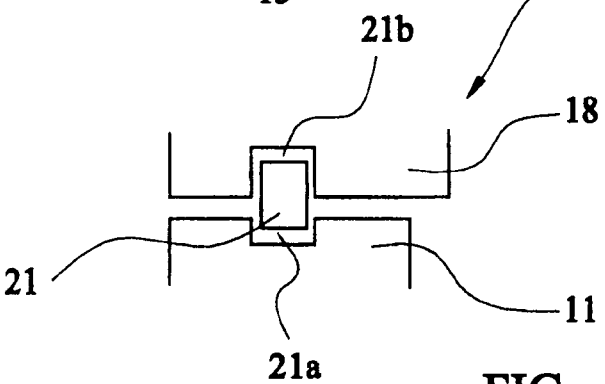
Figures 2, 2A, 3:
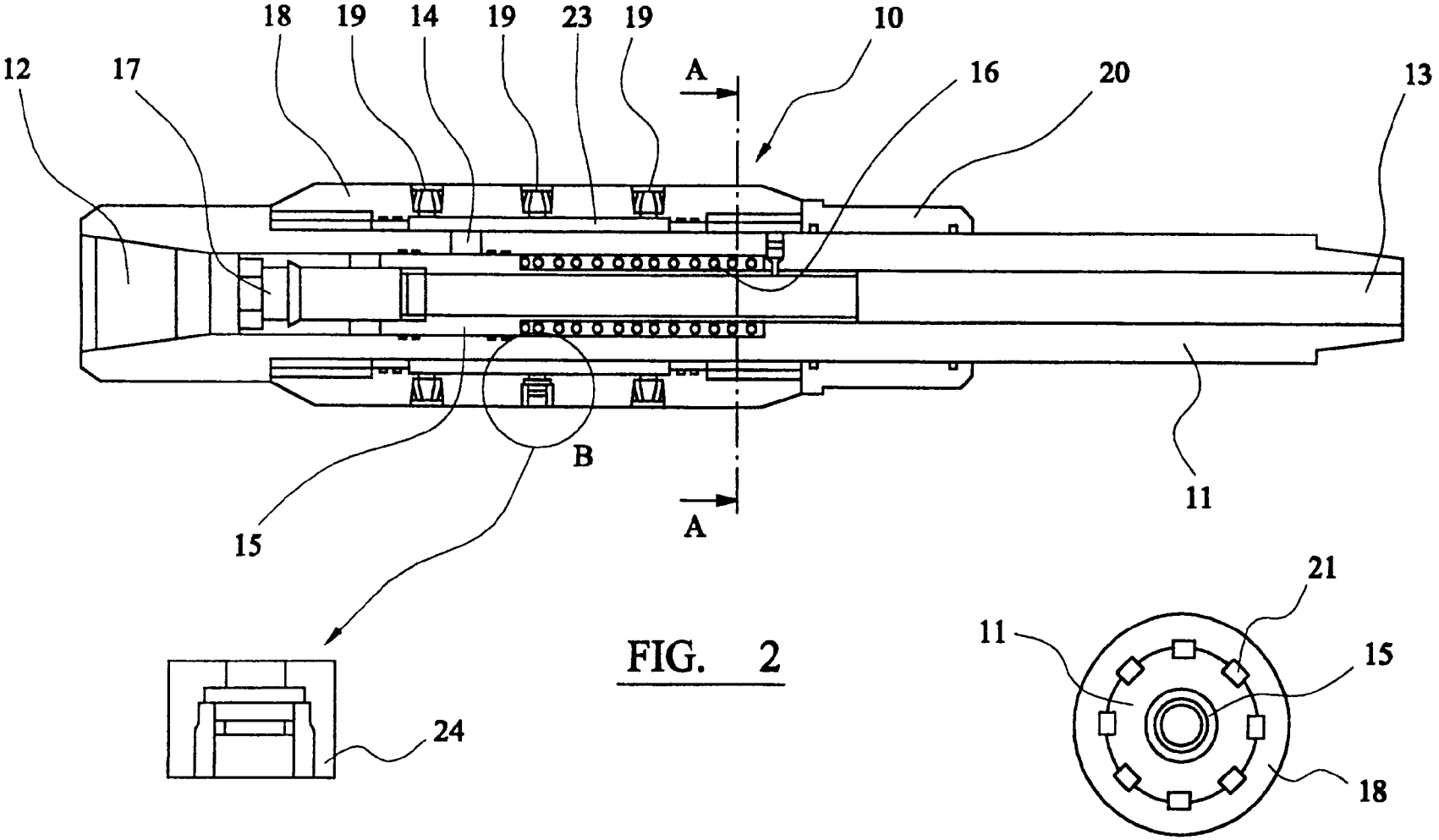
Figure 4:
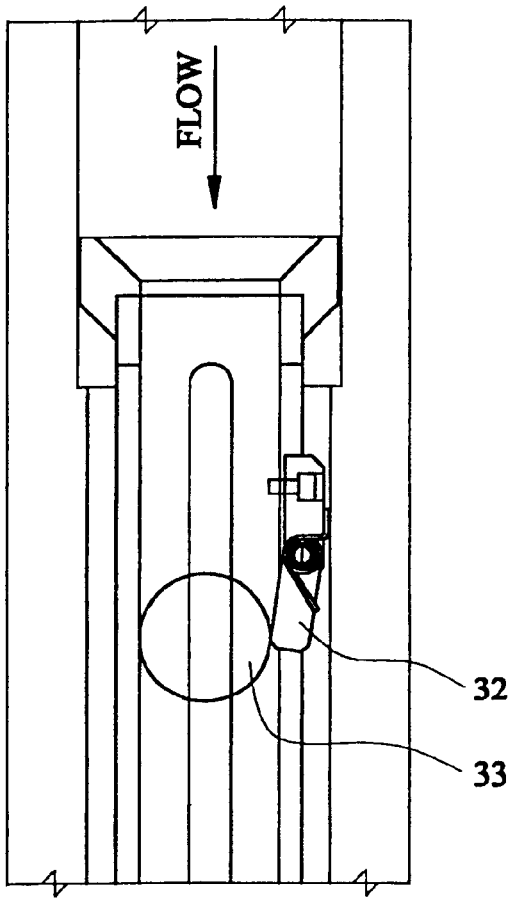
Figure 5:
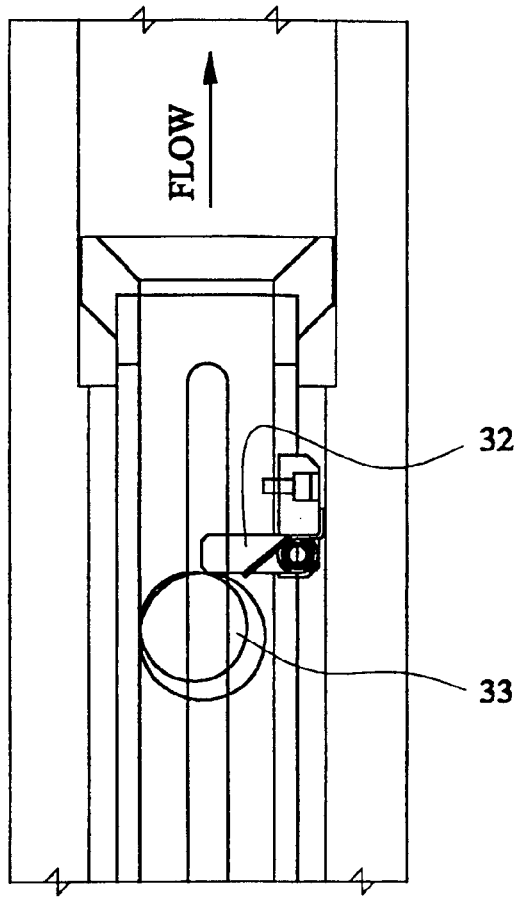

A preferred embodiment of jetting tool assembly according to the invention will now be described in detail, by way of example only, with reference to the accompanying drawings, in which:

FIG. 1 is a longitudinal sectional view of a downhole valve incorporated in a jetting tool assembly according to the invention, for use in a drillstring;

FIG. 1*a* is a view on detail A in FIG. 1;

FIG. 2 is a view, similar to FIG. 1, showing in more detail the engagement between an outer jetting body and an inner main body of the tool;

FIG. 2*a* is a view on detail B in FIG. 2;

FIG. 3 is a section taken on the line A—A in FIG. 2;

FIG. 4 is a detailed view of a retainer flap for use with a ball catcher device (not shown), and occupying a receiving position permitting downward movement of activating and deactivating balls when launched down the drillstring to activate and deactivate the tool assembly respectively; and FIG. 5 is a view, similar to FIG. 4, but showing the retainer flap returned to a retaining position, preventing upward movement to surface of any balls received by the catcher device.

Referring now to the drawings, there is shown a preferred embodiment of jetting tool assembly according to the invention, for use in a drillstring, and particularly for cleaning tubular components used during drilling operations for gaseous or liquid hydrocarbons e.g. BOPs, casings and risers.

The assembly is designated generally by reference 10, and is connectible to a hollow drill string, the assembly 10 having a first mode of operation which allows through-flow of fluid (e.g. drilling mud or other fluid), and lengthwise of the drillstring, and a second mode of operation which routes fluid transversely outwardly of the drilistring, primarily for cleaning purposes.

The assembly 10 comprises a hollow main body 11 through which axial flow of fluid can take place in the first mode of operation, such fluid being delivered to an inlet or receiving end 12 of the main body 11, and a through-flow outlet 13 from which the fluid is discharged axially from the assembly 10.

Outlet port means is provided in the wall of the main body, and which in the illustrated embodiment comprises a main port 14. Port 14 allows fluid to flow transversely of the drill string when the tool assembly has been activated to take-up its second mode of operation.

A control sleeve 15 is slidably mounted in the main body 11 for movement between a first position (as shown) in which it blocks communication between the interior of the main body 11 and the outlet port 14, and a second position (not shown) in which it allows communication between the interior of the main body 11 and the port 14, via a port 22 in the wall of the sleeve 15.

Means is provided internally of the main body 11 to bias the sleeve 15 towards the first position, and in the illustrated arrangement comprises a compression spring 16.

A ball-receiver arrangement 17 is provided at one end of the sleeve 15 to receive a ball when the latter is launched down the drillstring to activate the tool assembly, such a ball being a large deformable ball, as described in more detail in U.S. Pat. Nos. 4,899,199 and 5,499,687. The ball arrangement 17 is operative, when engaged by a launched ball, to move the sleeve 15 to the second position and against the action of the biassing spring 16.

A jetting body 18 is mounted externally on the main body 11, and has one or more jet outlets in the wall of the jetting body, and in the drawing there is shown a series of outlet jet nozzles 19. The outlet nozzles 19 are arranged to direct fluid outwardly against the internal wall of a surrounding tubular component for cleaning purposes when the tool assembly 10 has been activated.

The jet nozzle outlets 19 can be arranged to direct jets of cleaning fluid radially outwardly, or outwardly at an angle as may be required.

The jetting body 18 is mounted on the main body 11 to form a rigid assembly, and is assembled by slidable movement lengthwise of the main body to take up a required axial location on the main body. It is then locked in position e.g. by a retainer nut 20.

The jetting body is therefore held captive against movement longitudinally of the main body upon assembly, but means is also provided to hold the jetting body 18 and the main body 11 against relative rotation, and which in the illustrated arrangement comprises a spline and groove type of interfit between these two bodies (see FIG. 1*a*, or FIG. 3). In the illustrated embodiment, a series of eight circumferentially spaced spline bars 21 is provided, each engaging in aligned grooves 21*a* and 21*b* in the body 11 and body 18 respectively (see FIG. 1*a*). In the event of unacceptable erosive wear arising on any surface of the jetting body, after issuing from the main outlet port 14, the assembly of the main body II and the jetting body 18 may be released to allow slidable separation, followed by relative angular adjustment to align the spline bars and the grooves, and slidable assembly again. However, this time a new surface of the jetting body is brought into a position of engagement by the fluid flowing outwardly of the main outlet port 14 in the main body 11. In particular, it will be noted that port 14 communicates with the outlets 19 via an annular passage 23 defined between the outer surface of the body 11 and the inner surface of the body 18.

Plug inserts 24 (see FIG. 2*a*) may be provided, to be fitted into the outlet jet nozzles 19, and so designed that if the "bit" nozzle in the nozzle housing becomes plugged with debris, a brass insert plug can blow out of the insert housing when additional pressure is applied.

Conveniently, a ball catcher device (not shown) is provided, which will be arranged below the assembly 10, and which receives a deformable activating ball, and a hard deactivating ball, when the tool is deactivated.

To prevent any balls in the catcher device (now shown) being returned to the surface, a retainer flap arrangement may be provided, as shown in FIGS. 4 and 5, which acts like a one way valve to allow downward movement of the balls from the sleeve, but to prevent return upward movement to the surface of the balls. A spring loaded flap 32 is shown, and in FIG. 4 it is in an open position allowing ball 33 to be received by the ball catcher device, but in FIG. 5 it is shown having returned under spring action to a closed position preventing return upward movement of ball 33.

To provide further enhancement to the working life of the tool, the jetting body 18 may be reversed in its slidable mounting on the main body 11. 14 in the main body 1I when a ball has been launched down the tube.

What is claimed is:

1. A jetting tool assembly for use in cleaning tubular components used in drilling for gaseous or liquid hydrocarbons in producing formations, said assembly being connectable to a hollow drill string and having a first mode of operation which allows through-flow of fluid and lengthwise of the drill string, and a second mode of operation which routes the fluid transversely outwardly of the string, in which the assembly comprises:

a hollow main body through which axial flow of fluid can take place between an inlet end and an outlet end of the main body, in the first mode of operation;

an outlet port in the wall of the main body through which fluid can flow transversely of the drillstring in the second mode of operation;

a control sleeve slidably mounted in the main body for movement between a first position in which it blocks communication between the interior of the main body and said outlet port and a second position in which it allows communication between the interior of the main body and said outlet port means;

a biasing arrangement urging the sleeve in a direction towards said first position;

a ball-receiver arrangement at one end of the sleeve to receive a ball when the latter is launched down the drillstring to activate the tool assembly, said arrangement being operative when engaged by a launched ball to move the sleeve to the second position against the biasing arrangement, and returning the sleeve to the first position under the action of the biasing arrangement upon dislodgement of the ball;

a jetting body mounted externally on the main body; and one or more jet outlet in the wall of the jetting body and communicating with said outlet port so as to direct fluid outwardly against the internal wall of a surrounding tubular component for cleaning purposes when the tool assembly has been activated.

2. A tool assembly according to claim 1, in which the outlet port communicates with said jet outlets via an annulus provided in the outer surface of the main body.

3. A tool assembly according to claim 1, in which the jetting body is slidable lengthwise of the main body during assembly, and is retained against longitudinal displacement when assembled.

4. A tool assembly according to claim 3, including spline and groove interfit between the main body and the jetting body, to permit slidable movement for assembly and disassembly purposes.

5. A tool assembly according to claim 4, in which the splines and grooves are circumferentially spaced at equal distances, to allow relative angular adjustment to compensate for any erosive wear on the internal surface of the main jetting body.

6. A tool assembly according to claim 1, including one or more plug inserts locatable in a respective jet outlet to facilitate dislodgement of debris.

7. A tool assembly according to claim 1, including a displaceable retainer flap arranged in the path of travel of an activating ball, when the latter is displaced from engagement with the ball receiver arrangement in order to deactivate the tool assembly, said retainer flap arrangement returning to a closed position preventing return of a ball after being received by the ball catcher device.

* * * * *